United States Patent [19]

Daenen et al.

[11] 4,145,261

[45] Mar. 20, 1979

[54] ELECTROLYTE-LIQUID FOR THE ELECTRODEPOSITION OF ALUMINUM

[75] Inventors: Theo E. G. Daenen; Steven A. Stolk, both of Eindhoven, Netherlands

[73] Assignee: U.S. Philips Corporation, New York, N.Y.

[21] Appl. No.: 881,575

[22] Filed: Feb. 27, 1978

[30] Foreign Application Priority Data

Feb. 25, 1977 [NL] Netherlands ..... 7702018

[51] Int. Cl.[2] ..... C25D 3/44

[52] U.S. Cl. ..... 204/14 N

[58] Field of Search ..... 204/14 N, 14 R, 39

[56] References Cited

U.S. PATENT DOCUMENTS

| | | | |
|---|---|---|---|
| 2,170,375 | 8/1939 | Mathers | 204/14 N |
| 2,651,608 | 9/1953 | Brenner | 204/14 N |
| 3,268,421 | 8/1966 | McGraw | 204/39 |
| 3,595,760 | 7/1971 | Ishibashi | 204/14 N |
| 3,929,611 | 12/1975 | Hess | 204/14 N |

*Primary Examiner*—T. M. Tufariello

*Attorney, Agent, or Firm*—Norman N. Spain

[57] ABSTRACT

Electrolyte-liquid for electro-depositing aluminum. The liquid comprises an aprotic solvent with ether structure, a second aprotic solvent which is inert or which is capable of forming a coordinative compound, anhydrous aluminum chloride and a metal hydride.

The solvent with ether structure has the formula RO — $(CH_2)_m$ — O — $(CH_2)_n$— OR′ wherein m and n are integers between 1 and 6 and R and R′ are alkyl groups.

4 Claims, No Drawings

ELECTROLYTE-LIQUID FOR THE ELECTRODEPOSITION OF ALUMINUM

The invention relates to an electrolyte-liquid for the electrodeposition of ductile aluminium onto an electrically conducting substrate and, the preparation of that liquid.

U.S. Pat. No. 3,929,611 discloses such an electrolyte which comprises anhydrous aluminum chloride and a metal hydride, such as lithium-aluminum hydride in an anhydrous aprotic solvent. An ether, chosen from the group di-ethylether, ethyl n-butyl ether, anisole, phenetole and diphenyl ether is used as a solvent. White ductile aluminum can be precipitated from the electrolyte-liquid composition.

On the one hand these solvents have very low boiling points and very low flash points (di-ethyl ether 35° C. and −40° C. respectively) and, on the other hand, the bath components dissolve very poorly in these solvents. Especially on account of their inflammability these solvents are absolutely unsuitable for practical use.

Consequently, the electrodeposition of aluminum has sofar remained substantially a curiosity.

An article by J. J. Connor and A. Brenner in the J. Electrochem. Soc. 103, 657-662 (1956) mentions a number of other ether-like compounds with higher flash points but they are not used because either the $AlCl_3$ does not sufficiently dissolve therein or a disturbing chemical reaction is produced.

Applicants assertained inter alia that an electrolyte which comprises di-ethylene-glycoldimethyl ether as a solvent is not very attractive owing to the fact that $AlCl_3$ violently reacts with this solvent. In this reaction the solvent partially decomposes and an insoluble compound is formed.

The invention now provides a plating bath for the electrodeposition of aluminum with an aprotic solvent with ether structure, which does not contain unsoluble products. The advantages of the use of such high flash point ether compounds as a solvent are then fully utilized.

The electrolyte-liquid for the electrodeposition of Al according to the invention is characterized in that the aprotic solvent with ether-structre has a flashpoint exceeding 40° C. and satisfies the formula $RO-(CH_2)_m-O-(CH_2)_n-OR'$, wherein m and n are integers between 1 and 6 and R and R' represent alkylgroups and in that it contains in addition a second aprotic solvent, which does not react with $AlCl_3$ at all or which is capable of forming a coordination compound therewith.

The electrolyte liquid is prepared in that way that anhydrous aluminum chloride is first dissolved in an aprotic solvent which does not react with $AlCl_3$ or which is capable of forming a coordination compound with the aluminum ion, that a metal hydride is dissolved separately in an aprotic solvent with ether structure of the formula $RO-(CH_2)m-O-(CH_2)_n OR'$ having a flash point over 40° C., m and n being integers between 1 and 6 and R and R' representing alkyl groups and that both solutions are mixed in such a ratio by volume that no disturbing side reactions are produced.

The principle which underlies this method of preparation is that the solvent wherein the $AlCl_3$ was dissolved in the first instance or with which it forms the coordination compound respectively acts as a buffer for the reaction-heat released during mixing with the ether compound. In the presence of a sufficient quantity of this auxiliary solvent no decomposition of the ether compound occurs.

The pure solvent with ether structure is preferably added to the solution of the $AlCl_3$ in the inert aprotic solvent or the coordination aluminium compound and thereafter metal hydride is added to it in a quantity which is sufficient to dissolve the precipitate produced again.

It is true that in last-mentioned variant an aluminum chloride-ether compound precipitates which, however, is dissolved again by the addition of the metal hydride.

The inert aprotic solvents employed here may inter alia be toluene or pentane. Tetrahydrofurane or triethylamine can also be used, which also serve as a ligand in the formation of a coordinative aluminum compound. This coordinative compound can also be crystallized out and then introduced into the aprotic solvent with ether structure of a high flash point.

The last-mentioned aprotic solvent with ether structure can be diethylene glycoldimethylether, triethyleneglycoldimethylether, tetraethyleneglycoldimethylether or diethyleneglycoldiethylether.

The following examples illustrate methods for preparing an electrolyte-liquid of the invention. 1. Anhydrous aluminum chloride is dissolved in a quantity of 97.1 g in 42 g of dry toluene and thereafter 200 ml of dry diethyleneglycoldimethylether is added to the solution. A reaction takes place in which a grey precipitate is produced. 9.87 g if pure $LiAlH_4$, dissolved in 200 ml diethyleneglycoldimethylether, is added to the solution to precipitation and the solution is vigorously stirred. The precipitate dissolves again and a clear solution is obtained. 2. 200 g of anhydrous $AlCl_3$ is added to a mixture of 80 g of dry diethylether and 170 g of dry tetrahydrofurane, the solution is stirred until the $AlCl_3$ has completely dissolved. After cooling the compound $AlCl_3 . 2C_4H_8O$ crystallizes out and is filtered off. The filter residue, weighing 158.3 g, is introduced into a quantity of 213.6 g of diethyleneglycoldimethylether (flash point 70° C.). A slow reaction takes place in which a grey insoluble product is formed. After the addition of 3.15 g of pure $LiAlH_4$ this product dissolves again and a colourless, clear liquid is obtained.

From this solution white, ductile aluminum is electrodeposited at 25° C. onto a cathode which consists of copper. The anode consists of aluminum and the current density employed is $1A/dm^2$.

What is claimed is

1. A non-aqueous plating bath comprising a solution of anhydrous aluminum chloride and an alkali metal hydride in a mixture of a first anhydrous aprotic solvent having a flashpoint over 40° C. and of the formula $RO-(CH_2)_m-O-(CH_2)_n OR'$ wherein m and n are integers between 1 and 6 inclusive and R and R' are each alkyl and a second anhydrous aprotic solvent.

2. The plating bath of claim 1 wherein the second aprotic solvent is inert to the aluminum chloride.

3. The plating bath of claim 1 wherein the second anhydrous aprotic solvent is capable of forming a coordination compound with aluminum chloride.

4. The plating bath of claim 1 wherein the alkali metal aluminum hydride is lithium aluminum hydride.

* * * * *